US008307498B2

(12) United States Patent
Krammer

(10) Patent No.: US 8,307,498 B2
(45) Date of Patent: Nov. 13, 2012

(54) DAMPING DEVICE FOR DAMPING AN OPENING AND/OR CLOSING MOTION OF A FURNITURE FITTING

(75) Inventor: Bernhard Krammer, Höchst (AT)

(73) Assignee: Julius Blum GmbH, Hochst (AT)

( * ) Notice: Subject to any disclaimer, the term of this patent is extended or adjusted under 35 U.S.C. 154(b) by 51 days.

(21) Appl. No.: 12/897,168

(22) Filed: Oct. 4, 2010

(65) Prior Publication Data

US 2011/0019946 A1 Jan. 27, 2011

Related U.S. Application Data

(63) Continuation of application No. PCT/AT2009/000140, filed on Apr. 8, 2009.

(30) Foreign Application Priority Data

Apr. 11, 2008 (AT) ..... A 573/2008

(51) Int. Cl.
*E05F 5/04* (2006.01)

(52) U.S. Cl. ..... 16/83; 16/82; 16/50

(58) Field of Classification Search ..... 16/277, 16/298–303, 354, 82–86 C
See application file for complete search history.

(56) References Cited

U.S. PATENT DOCUMENTS

| | | | | |
|---|---|---|---|---|
| 4,110,867 | A * | 9/1978 | Gwozdz | 16/82 |
| 4,194,264 | A * | 3/1980 | Stoffregen | 16/52 |
| 6,408,483 | B1 * | 6/2002 | Salice | 16/85 |
| 6,591,454 | B2 * | 7/2003 | Brustle | 16/374 |
| 6,684,453 | B2 * | 2/2004 | Wang | 16/54 |
| 7,127,778 | B2 * | 10/2006 | Salice | 16/354 |
| 7,207,087 | B2 * | 4/2007 | Salice | 16/374 |
| 7,275,284 | B2 * | 10/2007 | Lautenschlager et al. | 16/287 |
| 7,395,580 | B2 * | 7/2008 | Brustle et al. | 16/50 |
| 7,562,416 | B2 * | 7/2009 | Lautenschlager et al. | 16/286 |
| 7,600,295 | B2 * | 10/2009 | Zimmer | 16/286 |
| 7,669,285 | B2 * | 3/2010 | Gallasch et al. | 16/286 |
| 7,748,082 | B2 * | 7/2010 | Harald et al. | 16/286 |
| 2004/0093693 | A1 * | 5/2004 | Salice | 16/354 |
| 2008/0109987 | A1 * | 5/2008 | Chen et al. | 16/68 |

(Continued)

FOREIGN PATENT DOCUMENTS

| | | |
|---|---|---|
| AT | 5429 | 7/2002 |

(Continued)

OTHER PUBLICATIONS

International Search Report issued Jul. 3, 2009 in International (PCT) Application No. PCT/AT2009/000140.

(Continued)

*Primary Examiner* — Jeffrey O Brien
(74) *Attorney, Agent, or Firm* — Wenderoth, Lind & Ponack, L.L.P.

(57) ABSTRACT

The invention relates to a damping device for damping an opening and/or closing motion of a furniture fitting. The damping device includes a restoring mechanism, by which an actuating element of the damping device can be moved into a starting position of the subsequent damping stroke after damping has been carried out. The location of the starting position of the actuating element can be set relative to the damping device by an adjusting unit. The actuating element of the damping device is rotatably supported, and the adjusting unit can be used to adjustably limit the restoring stroke of the actuating element relative to the damping device.

20 Claims, 10 Drawing Sheets

U.S. PATENT DOCUMENTS

| | | | | |
|---|---|---|---|---|
| 2008/0209674 | A1* | 9/2008 | Harald et al. | 16/82 |
| 2009/0083939 | A1* | 4/2009 | Wu | 16/85 |
| 2010/0269294 | A1* | 10/2010 | Krammer | 16/308 |
| 2011/0094055 | A1* | 4/2011 | Domenig et al. | 16/83 |

FOREIGN PATENT DOCUMENTS

| | | |
|---|---|---|
| AT | 502 964 | 6/2007 |
| DE | 201 07 068 | 8/2001 |
| DE | 10 2006 007 702 | 8/2007 |
| DE | 10 2007 037 480 | 3/2008 |
| GB | 20 2005 002 609 | 5/2005 |
| WO | 2007/009899 | 1/2007 |
| WO | 2007/009902 | 1/2007 |
| WO | 2008/083417 | 7/2008 |

OTHER PUBLICATIONS

Austrian Patent Office Search Report completed Feb. 18, 2009 in Austrian patent application No. A 573/2008.

* cited by examiner

DAMPING DEVICE FOR DAMPING AN OPENING AND/OR CLOSING MOTION OF A FURNITURE FITTING

This application is a Continuation of International application PCT/AT2009/000140, filed Apr. 8, 2009.

BACKGROUND OF THE INVENTION

The present invention relates to a damping device for damping an opening and/or closing movement of a furniture fitting. The damping device has a return mechanism, by which an actuating element of the damping device is movable after damping has been effected into a starting position for the next damping stroke. The location of the starting position of the actuating element is adjustable relative to the damping device by an adjusting device.

The invention further concerns a furniture fitting as well as an article of furniture having a damping device of the kind to be described.

It is known in the state of the art for furniture fittings to be equipped with a damping device so that a damped movement of the movable furniture part into at least one of the two end positions can take place. In that case, an actuating element associated with the damping device is acted upon by an abutment portion or by the movable furniture part itself, as from a given relative position of the furniture fitting, and that initiates the beginning of the damping operation. In addition, there is also provided a return mechanism by which the actuating element can be movable into a starting position for the next damping stroke again after damping has occurred. When using furniture fittings with integrated damping, however, the furniture part to be moved can be braked excessively so that the resulting closing or opening time for the movable furniture part exceeds a tolerable amount. In the extreme case, it is even possible that no complete movement of the movable part at all towards the desired end position is possible. If two furniture fittings are arranged for guided movement of a movable furniture part, it would basically be possible for the first furniture fitting of the movable furniture part to be equipped with a damping function while the second furniture fitting does not have a damping device. In the sense of a movement characteristic which is as optimum as possible, however, exact adaptation to the respective weight of the furniture part to be moved is not possible in that fashion.

WO 2007/009899 A1 and WO 2007/009902 A1 disclose furniture hinges with a linear damper for damping a hinge movement. The linear damper in that case includes a cylinder and a piston which is linearly displaceable in the cylinder and which has a piston rod coupled thereto, wherein the length of the stroke of the piston rod relative to the cylinder is adjustable. The field of use described in those publications is limited to linear dampers.

The object of the present invention is to provide a damping device of the general kind referred to in the opening part of this specification, while avoiding the foregoing disadvantages.

SUMMARY OF THE INVENTION

In accordance with the invention, an advantageous configuration is achieved in that the actuating element of the damping device is rotatably supported. The return stroke of the actuating element can be adjustably limited relative to the damping device by an adjusting device.

Accordingly therefore the return stroke of a rotatable actuating element of the damping device is adjustably limited.

Thus, the return movement of the actuating element of the damping device can be limited by the adjusting device, whereby the length of the damping stroke can be varied. Accordingly, the return stroke of the actuating element relative to the damping device can be reduced by the adjusting device.

In accordance with an embodiment of the invention, the return stroke of the actuating element can be altered relative to the damping device stepwise, preferably at predetermined positions, by the adjusting device. In that case, the actuating element can be latched at various defined positions, in which case the location of those predetermined positions corresponds to a partial travel movement of the maximum damping stroke of the actuating element. The actuating element is then movable starting from an end position over a limited path of movement towards the arresting effect predetermined by the adjusting device, and in the reverse direction.

In accordance with a further embodiment of the invention, the return stroke of the actuating element can be substantially completely deactivated relative to the damping device by the adjusting device. In that way, the actuating element—preferably after damping has been effected—can be arrested in that end position so that the actuating element cannot be returned at all. Such a construction can provide that the damping device of the furniture fitting can be taken entirely out of operation.

The damping device can have at least two damping components which are mounted movably relative to each other in a damping stroke. The actuating element is operatively connected to one of the two damping components at least in the damping stroke. In that respect, the actuating element can be arrested by the adjusting device in various rotary positions.

Fluid dampers, in particular rotational dampers, can be provided as the damping device, in which case all damping media known in the state of the art such as, for example, silicone oils can be used.

The return mechanism can include at least one spring by which the actuating element can be moved back into a starting position for the next damping stroke again after damping has occurred in order at the end of the damping stroke to permit a return stroke, at the end of which the actuating element or the damper and its damping components have again assumed a starting position for the next damping stroke. The return mechanism can also have a freewheel mode, in which an arresting device having an arresting position and a freewheel position are provided. The return mechanism can also be formed by a valve structure of a damping device which permits a return flow of the damping fluid after damping has occurred and thus a return movement of the actuating element. Such return mechanisms, however, are known in the state of the art and do not need to be described in greater detail at this juncture.

The furniture fitting according to the invention can be either in the form of a furniture hinge, an extension guide for drawers, or an adjusting mechanism for a furniture flap. In that respect, the damping device in question can be arranged so that it damps a relative movement—in particular, a linear movement and/or a pivotal movement—of at least two abutment portions to be fixed to a furniture part. In that respect, in the case of furniture hinges, the relative movement of the hinge cup to the hinge arm can be damped, in the case of an extension guide for drawers, the relative movement of two rails can be damped, and in the case of an adjusting mechanism, the pivotal movement of an adjusting arm provided for movement of the furniture flap can be damped. For reasons of simplicity, the arrangement of a damping device on a furniture hinge is illustrated in the accompanying Figures. It will be directly apparent to the man skilled in the relevant art, on the basis of the illustrated embodiments, how the arrangement of the damping device on an extension guide fitment for drawers or on an adjusting mechanism for the movement of a furniture flap is to be implemented.

The article of furniture according to the invention is characterized by a furniture fitting having a damping device of the kind in question.

BRIEF DESCRIPTION OF THE DRAWINGS

Further details and advantages of the present invention are described with reference to the specific description hereinafter, in which.

DETAILED DESCRIPTION OF THE INVENTION

Figure 1:
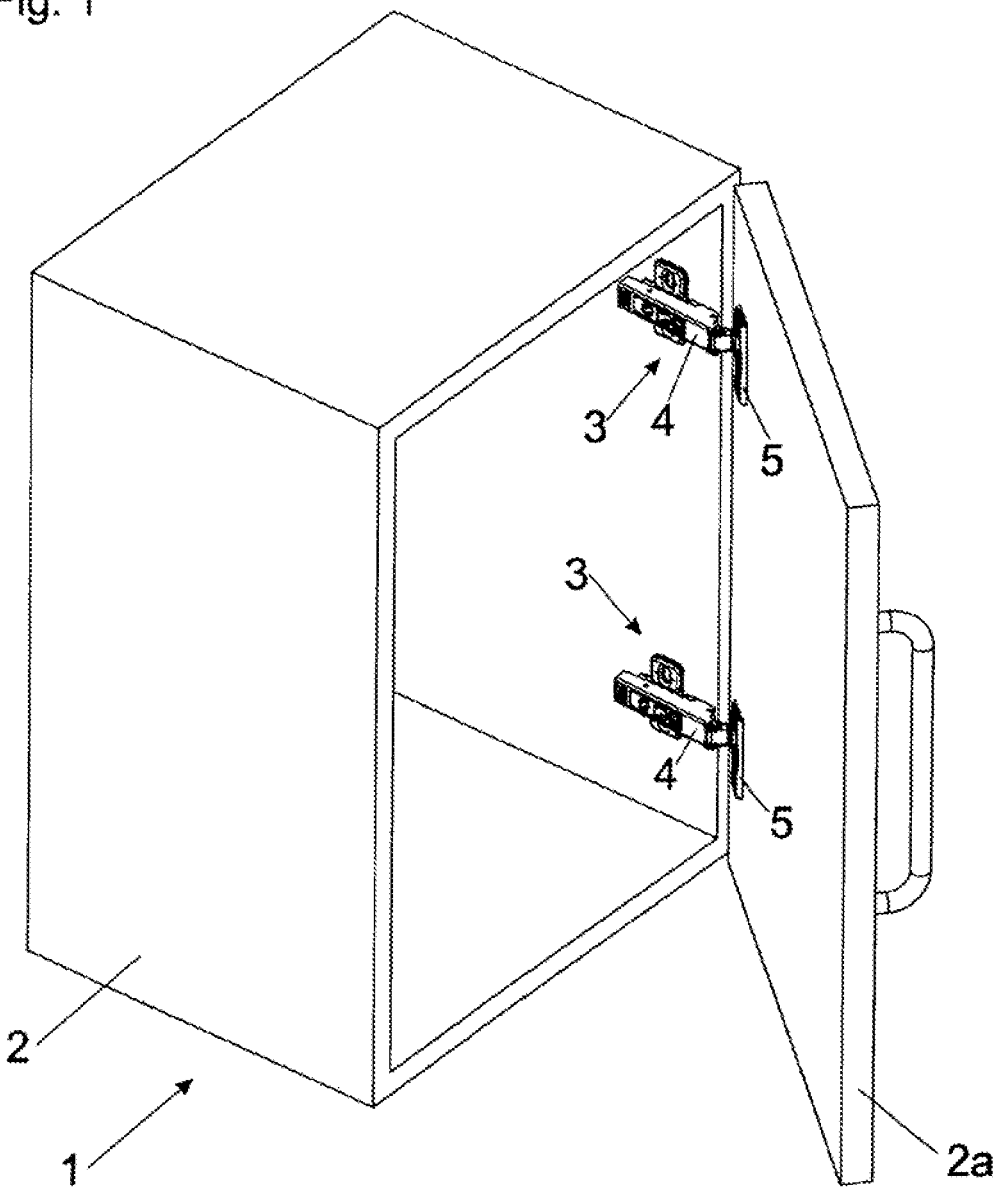
FIG. 1 shows a perspective view of an article of furniture having a movable furniture part pivotably mounted to the furniture carcass by two furniture hinges.

FIG. 1 shows a perspective view of an article of furniture 1 having a furniture carcass 2 to which furniture fittings in the form of furniture hinges 3 for pivotably mounting a movable furniture part 2*a* are mounted. Both furniture hinges 3 have a hinge arm 4 to be fixed to the furniture carcass 2, and a hinge cup 5 which is hingedly arranged thereon and which is recessed in a bore provided on the rear side of the movable furniture part 2*a*. Depending on the respective size and weight of the movable furniture part 2*a*, the closing time or the opening time in respect of the damping action can exceed a tolerable amount so that the damping effect in the direction of one of the two end positions of the movable furniture part 2*a* inadequately satisfies the wish for an optimized movement characteristic. In addition, the furniture hinges 3 have a return mechanism (not visible in greater detail here) for an actuating element, wherein the return movement of the actuating element is adjustably limited by an adjusting device which is still to be described. In that way, damping is effected only over a part of the damping range provided as standard.

Figure 2A:
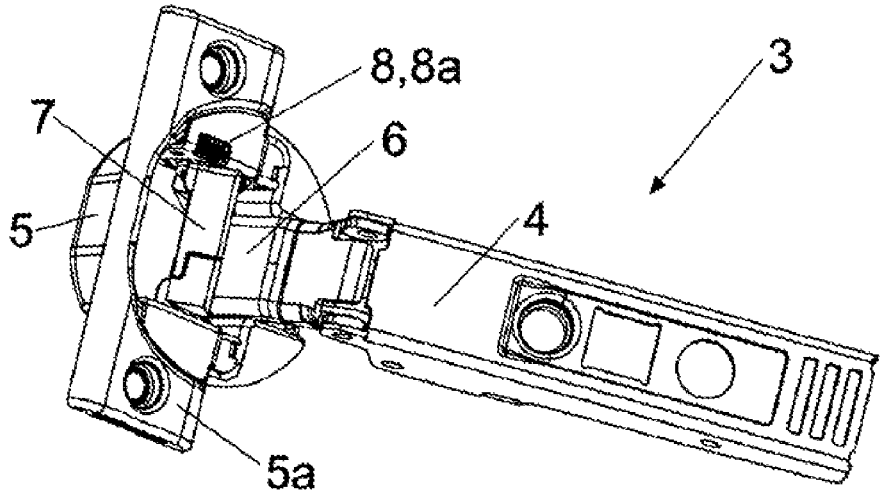
FIGS. 2*a* and 2*b* show various perspective views of the furniture hinge.
Figure 2B:
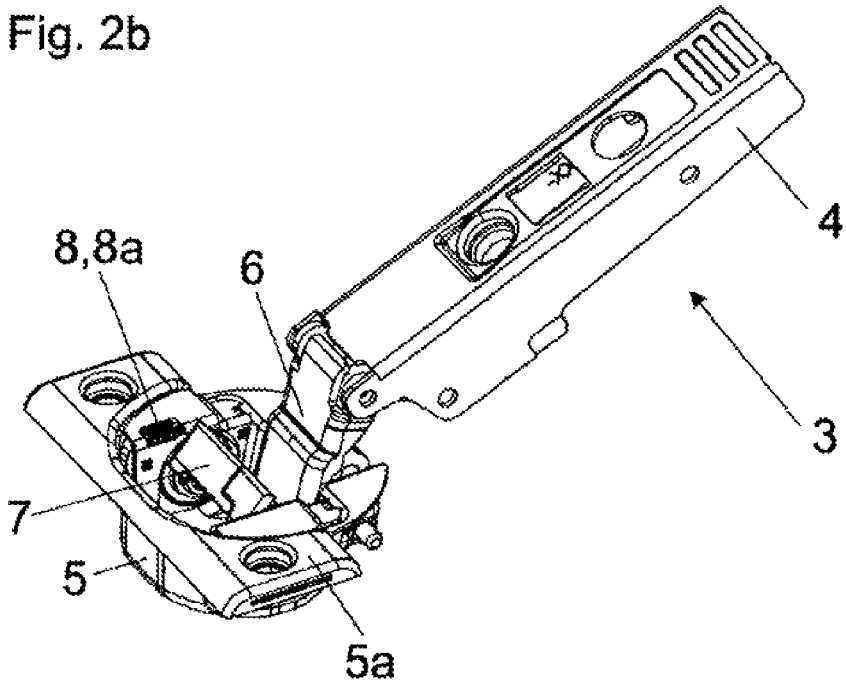

FIGS. 2*a* and 2*b* each show a furniture hinge 3 in different perspective views. The furniture hinge 3 has a hinge arm 4 and a hinge cup 5 which are pivotably connected together by way of at least one hinge lever 6. The hinge cup 5 includes a per se known fixing flange 5*a*. It is possible to see an actuating element 7 of a damping device of the furniture hinge 3, which is supported rotatably within the hinge cup 5. The actuating element 7 of the damping device in the illustrated Figure is in a readiness position for a damping stroke. As from a certain closed position of the furniture hinge 3, the outer hinge lever 6 encounters the rotatable actuating element 7, and that initiates the beginning of the damping stroke. In a further closing movement, the actuating element 7 is pushed completely into the hinge cup 5 by the hinge lever 6, wherein that pivotal movement of the actuating element 7 is damped by the damping device (not visible in greater detail here) so that the hinge movement also takes place in damped relationship to the completely closed position. The Figure also diagrammatically indicates an adjusting device 8 having a switch 8*a* which is arranged on the hinge cup 5 and by which the location of the starting position of the actuating element 7 relative to the damping device is adjustable. In that way, the return movement of the actuating element 7, starting from the completely pushed-in position, can be adjustably limited. In the illustrated embodiment, the switch 8*a* is linearly displaceable and includes at least two switching positions, wherein one switching position can permit complete return of the actuating element 7 and a further switching position can permit a limited return movement of the actuating element 7 after damping has occurred. The damping device can also be substantially completely deactivated by the adjusting device 8. For reasons of precise adaptation, however, it may be advantageous to allow a return function of the actuating element over a limited part of the complete return movement, by the adjusting device 8, whereby damping is also effected only over a part of the complete damping range.

Figure 3:
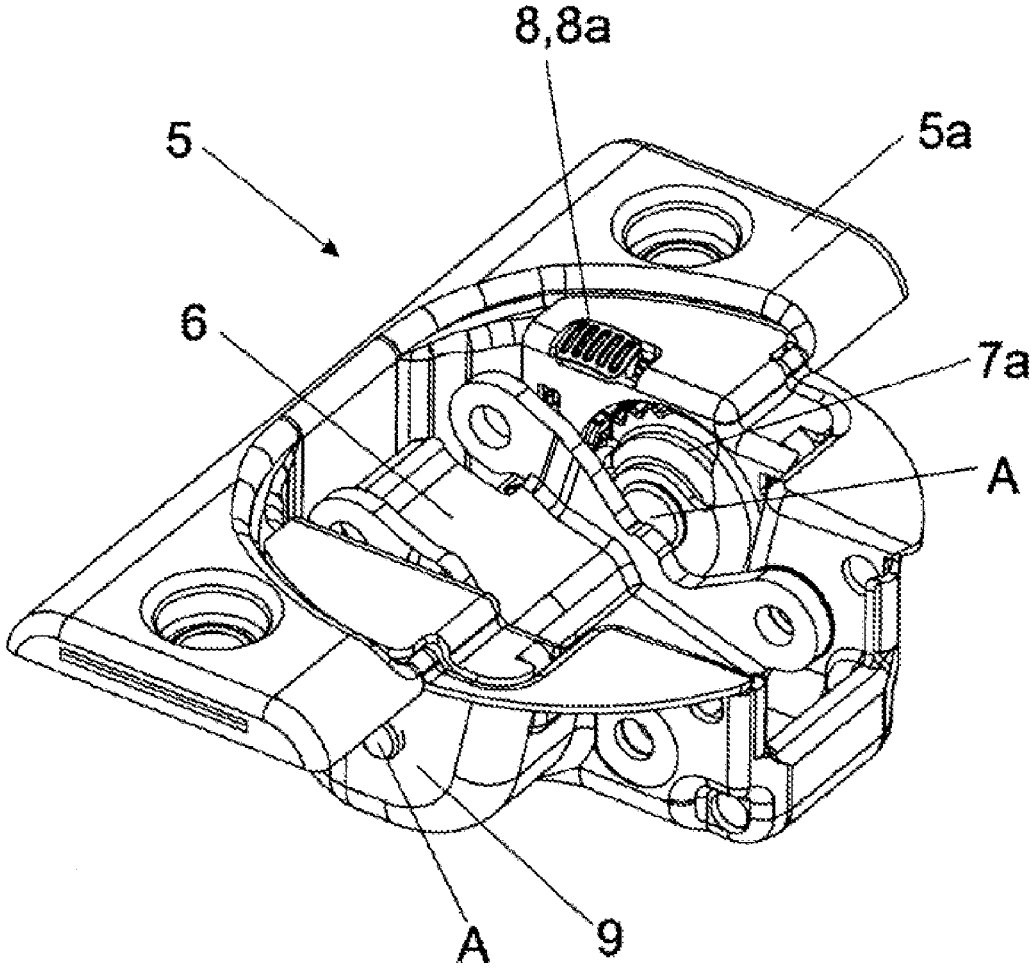
FIG. 3 shows the hinge cup with the hinge arm removed.

FIG. 3 shows a perspective view of the hinge cup 5, with the hinge arm 4 being omitted for the sake of clarity. In the illustrated Figure, the actuating element 7 is concealed by the hinge lever 6 acting thereon, wherein the actuating element 7 which is pivotable about axis of rotation A is disposed in a pushed-in position relative to the hinge cup 5. Associated with the actuating element 7 is a rotor 7*a* which also forms part of a return mechanism for the return of the actuating element 7. The rotor 7*a* of the return mechanism is mounted opposite to a damping device 9 on the hinge cup 5, wherein the rotor 7*a* with the return mechanism and the damping device 9 are respectively disposed at an outside wall which is a lateral wall in the mounting position and, in the mounting position, beneath the fixing flange 5*a* of the hinge cup 5. Damping of the actuating element 7 is therefore effected by the damping device 9 while the return of the actuating element 7 is effected by means of the rotor 7*a* of the return mechanism. The return mechanism can include, for example, a torsion spring by which the rotor 7*a* can be turned back into a starting position again for the next damping stroke, after damping has occurred, by the loaded torsion spring. At its outside peripheral surface, the rotor 7*a* has a plurality of toothed configurations or recesses into which an arresting element (still to be described) of the adjusting device 8 can engage. The adjusting device 8 with the switch 8*a* is disposed in the illustrated Figure in a position in which unimpeded return movement of the rotor 7*a* (and therewith the actuating element 7) is possible.

Figure 4A:
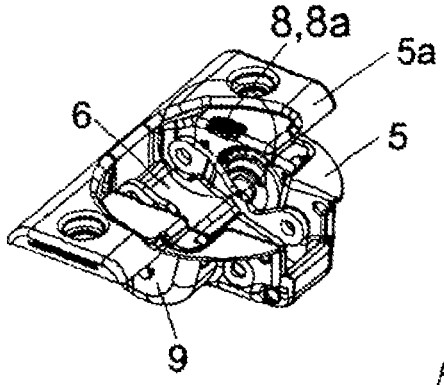
FIGS. 4*a*-4*e* show various views of the hinge cup with the adjusting device for limiting the return stroke of the actuating element.
Figure 4B:
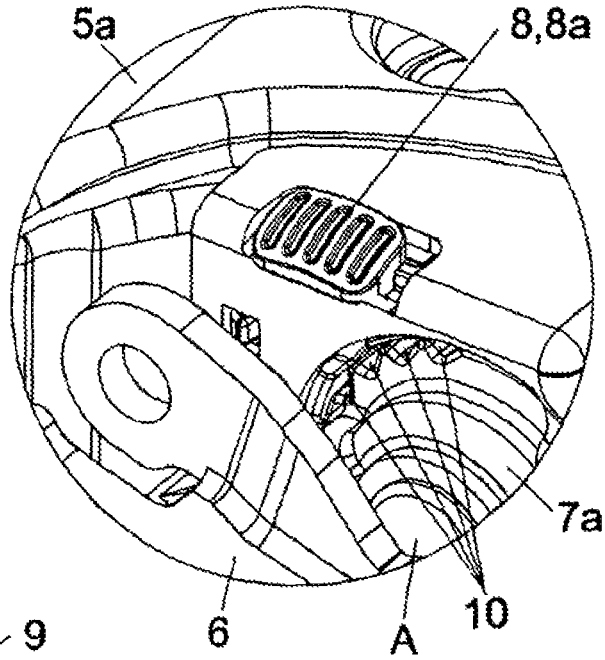
Figure 4C:
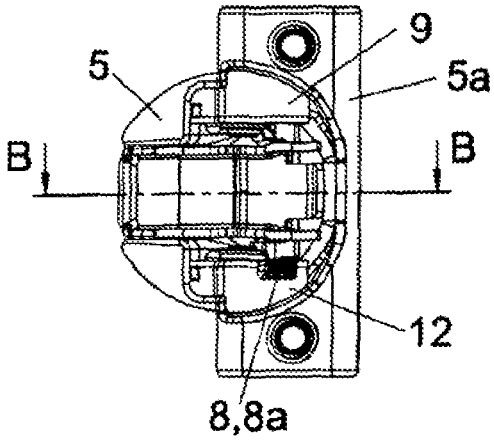
Figure 4E:
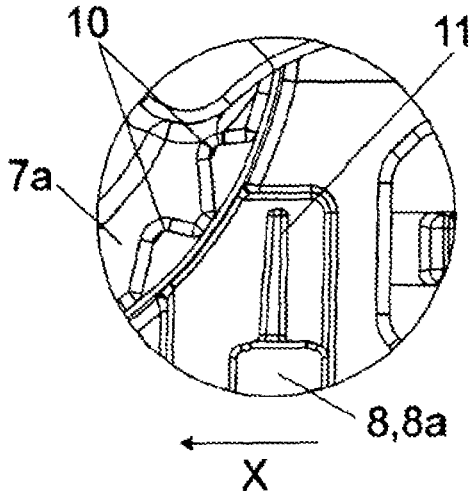
Figure 4D:
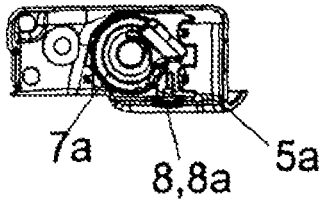

FIG. 4*a* shows essentially the same view as FIG. 3. FIG. 4*b* shows the region circled in FIG. 4*a*, on an enlarged scale. The rotor 7*a* which is non-rotatably connected to the actuating element 7 can rotate about the axis of rotation A during the damping operation and during the return movement, respectively. The rotor 7*a* is provided with recesses 10 into which an arresting element 11 (not visible in greater detail here) of the adjusting device 8—preferably of the switch 8*a*—can engage. In the illustrated FIG. 4*e*, however, the switch 8*a* is in a position which permits unimpeded return movement of the rotor 7*a* and the actuating element 7 formed thereon. FIG. 4*c* shows a plan view of the top side of the hinge cup 5. Provided beneath the fixing flange 5*a* is a damping device 9 and a diametrically opposite return mechanism 12, which can be arranged as mutually separate units on the hinge cup 5. It will be appreciated that it is also possible for the damping device 9 and the return mechanism 12 to be integrated in a common unit. FIG. 4*d* shows a sectional view along section line B-B in FIG. 4*c*. FIG. 4*e* shows the region circled in FIG. 4*d* of the adjusting device 8 on an enlarged scale. It is possible to see the rotor 7*a* with its recesses 10. The partly visible switch 8*a* includes a resilient arresting element 11, wherein in a movement of the switch 8*a*, in the direction of the arrow X, the arresting element 11 can be parked into one of the recesses 10 whereby further movement of the rotor 7*a* in the direction of the open position is blocked but a return movement towards the completely closed position is possible. Depending on the configuration of the respective recess 10 in which the arresting element 11 is parked, the return movement of the rotor 7*a* (and therewith the actuating element 7) is also adjustably limited.

FIGS. 5*a* through 5*e* show similar views to FIGS. 4*a* through 4*e* with the difference being that now the switch 8*a* of the adjusting device 8 has been displaced into another switching position. It is apparent, particularly from the enlarged-scale detail view in FIG. 5*b*, that a resilient arresting element 11 formed on the switch 8*a* engages into one of the recesses 10 in the rotor 7*a*. The rotor 7*a* and the actuating element 7 connected thereto can therefore now only be moved within a limited rotary angle range which extends between the completely pushed-in position of the actuating element 7 and the latching position between the arresting element 11 and the respective recess 10 in the rotor 7*a*. It will be seen from FIG. 5*e* that the adjusting device 8 with the switch 8*a* has been displaced towards the left in comparison with FIG. 4*e* so that the resilient arresting element 11 is in an engagement position with one of the recesses 10 in the rotor 7*a*.

Figure 5A:
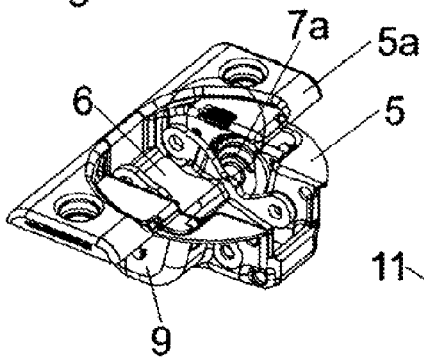
FIGS. 5*a*-5*e* show similar views to FIGS. 4*a* through 4*e* with a limited actuating element damping stroke.
Figure 5B:
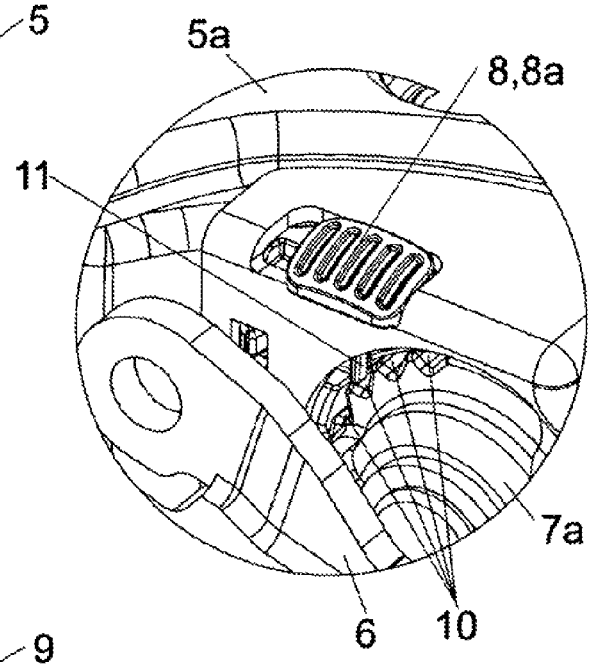
Figure 5C:
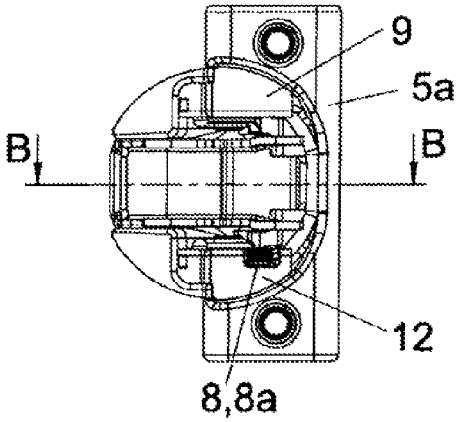
Figure 5E:
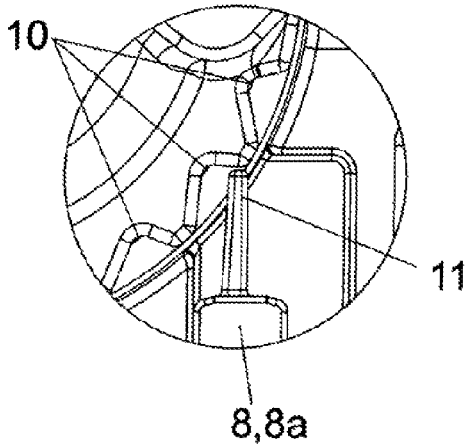
Figure 5D:
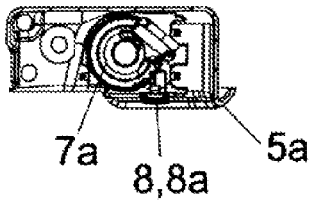
Figure 6A:
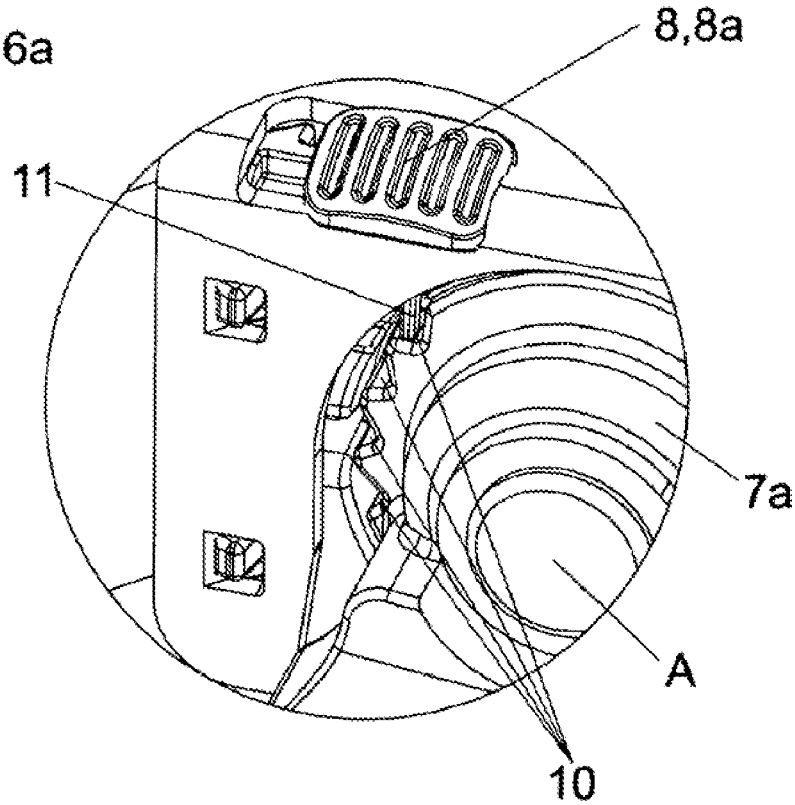
FIGS. 6*a* and 6*b* show various starting positions of the actuating element.
Figure 6B:
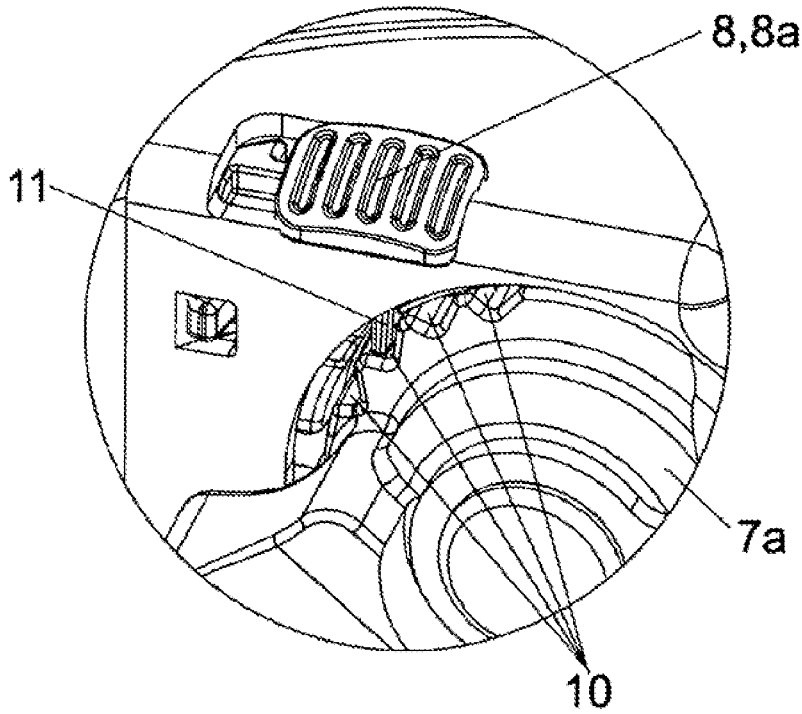

FIGS. 6*a* and 6*b* show similar views to FIG. 5*b*, with the switch 8*a* in FIG. 6*a* being in engagement with the uppermost recess 10 of the rotor 7*a*. That corresponds to the fully pushed-in position of the actuating element 7. By virtue of the arresting effect in that position, the rotor 7*a* can no longer be moved by the return mechanism 12 into a starting position for a damping stroke whereby the damping function of the furniture hinge 3 is completely deactivated. FIG. 6*b* shows a latching position which is altered in relation to FIG. 6*a* between the arresting element 11 and the rotor 7*a*, whereby the actuating element 7 is movable over approximately half of the damping stroke provided as standard, and can thus at least partially provide a damping force. It is also apparent that the switch 8*a* can also be actuated in a further open position of the furniture hinge 3 by virtue of the resilient configuration of the arresting element 11, in which case the arresting element 11 runs on the outside peripheral surface of the rotor 7*a*. In the region of the recesses 10, the arresting element 11 can pass over the recesses 10 in the rotor 7*a* in one direction, but they block the rotor 7*a* in the opposite direction. In that way, the actuating element 7 can be latched gradually (in the desired position) in the direction of the end position (starting from FIG. 6*b* towards FIG. 6*a*).

Figure 7A:
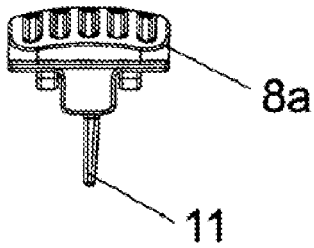
FIGS. 7*a* and 7*b* show various views of a switch of the adjusting device having an arresting element.
Figure 7B:
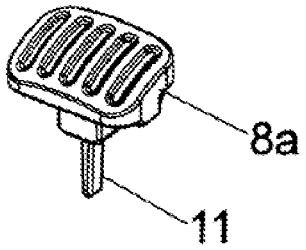

FIGS. 7*a* and 7*b* show a side view and a perspective view of the switch 8*a* of the adjusting device 8. It is possible to see an arresting element 11 or latching portion in the form of a peg which is injection molded in place and which can engage into recesses 10 in the rotor 7*a*. The resilient arresting element 11 can also have a mechanical spring element which is operative in the direction of the arresting position.

Figure 8A:
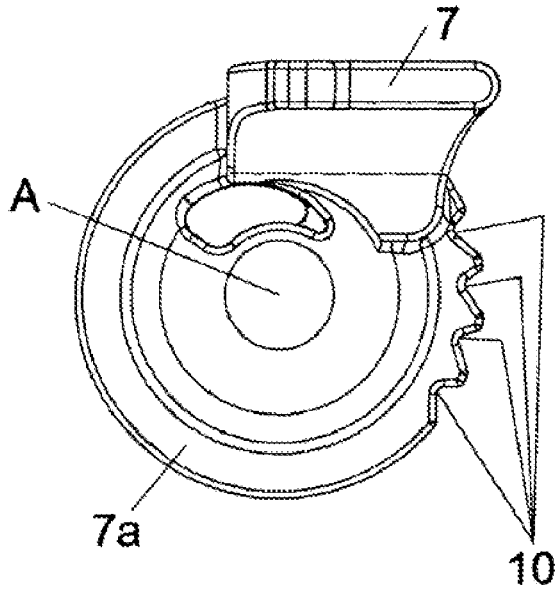
FIGS. 8*a* and 8*b* show various views of the actuating element and the associated rotor of the return mechanism.
Figure 8B:
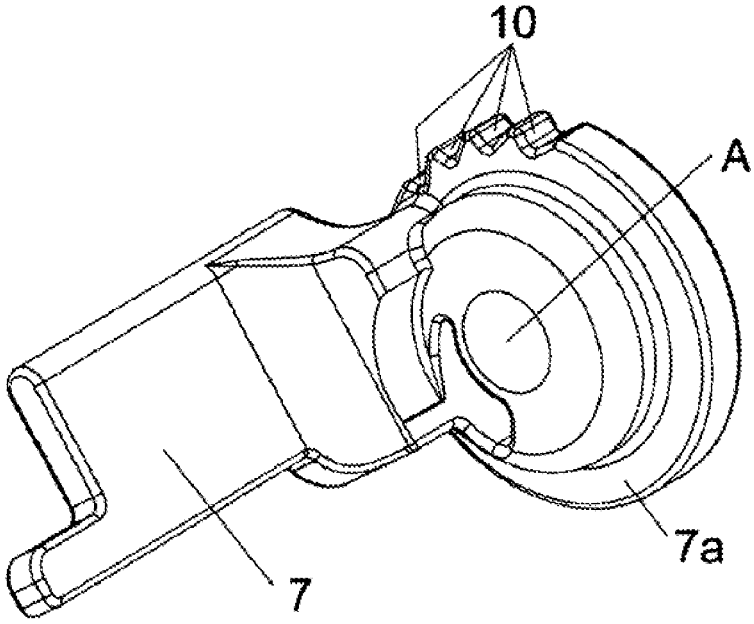

FIG. 8*a* shows a side view of the rotor 7*a* with the actuating element 7 formed thereon for the damping device 9 (not shown here). It is possible to see the recesses 10 for the arresting element 11. The rotor 7*a* is mounted about the axis of rotation A (see FIG. 3). Starting from the end position of the rotor 7*a*, it can be moved by a return spring (not shown here) of a return mechanism in a starting position for the next damping stroke. FIG. 8*b* shows a perspective view of the actuating element 7 with the rotor 7*a* formed thereon and its recesses 10. The free end of the actuating element 7 can be connected, preferably latched, to a damping component of the damping device 9.

FIGS. 9*a* through 12 show a highly diagrammatic embodiment of a rotatable rotor 7*a* and the actuating element 7 non-rotatably connected thereto, in which a possible operating principle of the invention will be described by means of the description hereinafter.

Figure 9A:
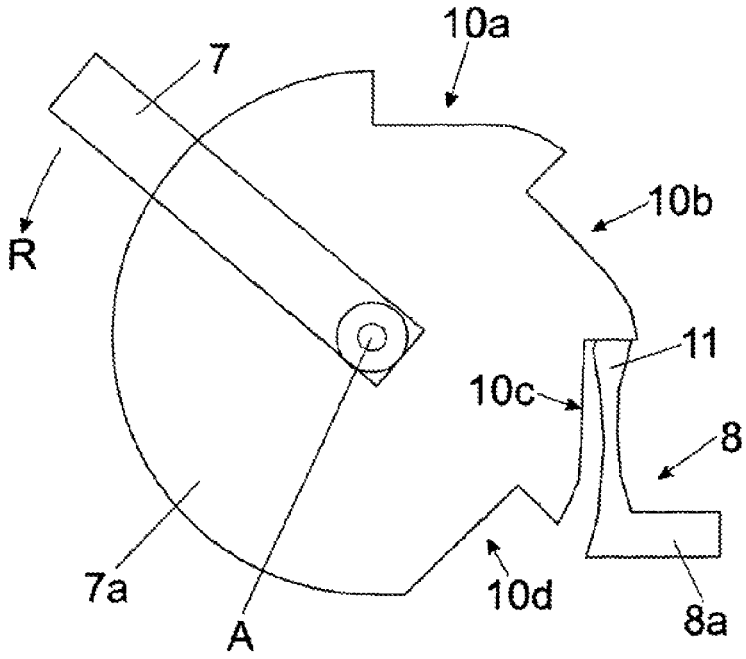
FIGS. 9*a* and 9*b* show highly diagrammatic views of the rotor having an arresting element in a recess for limiting the return of the rotor at the beginning and at the end of the damping stroke.
Figure 9B:
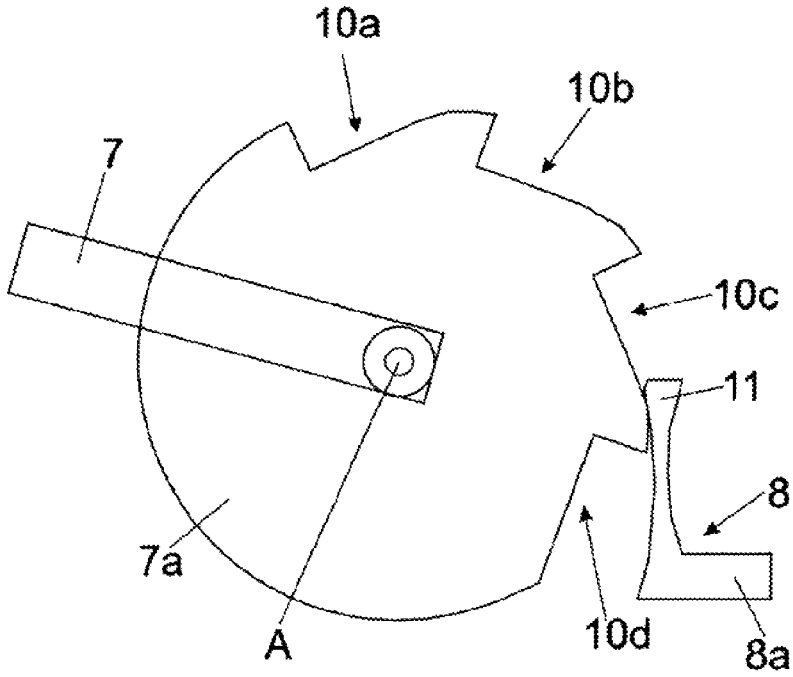

FIG. 9*a* shows the adjusting device 8 with the switch 8*a* with the arresting element 11 arranged thereon. The rotor 7*a* includes a plurality of recesses 10*a*-10*d* provided for adjustably limiting the return stroke. That provides that the return mechanism 12 (FIG. 4*c*) which is not visible here can only move the rotor 7*a* back over a part of the maximum available return stroke. In the illustrated position in FIG. 9*b*, the arresting element 11 is in the recess 10*c* of the rotor 7*a* so that the rotor 7*a* is movable about its axis of rotation A only in the closing direction (that is to say in the counter-clockwise direction). Starting from the position shown in FIG. 9*a*, the actuating element 7 is rotatable in the direction of the arrow R (closing direction) by virtue of actuation by the hinge lever 6 of the furniture hinge 3 until the actuating element 7 assumes the position shown in FIG. 9*b*. The movable furniture part 2*a* has already reached the completely closed position in FIG. 9*b*. In that case, the rotor 7*a*, however, only moves so far relative to the stationary arresting element so that throughout the entire damping stroke, the arresting element 11 moves exclusively within the tooth width of the recess 10*c* and cannot latch into the next recess 10*d*. The rotor 7*a* is therefore rotated together with the actuating element 7 through, for example 25°, whereupon the damping stroke is already concluded. The rotary movement of the rotor 7*a* is limited by the movable furniture part 2*a* abutting against the furniture carcass 2 (that is to say by reaching the closed position of the movable furniture part 2*a*). It is also to be stated in this context that the rotary angle range covered in respect of the movable furniture part 2*a* is a multiple higher than the rotary angle range covered in respect of the rotor 7*a*. Starting from the completely closed position of the movable furniture part 2*a* (FIG. 9*b*), the rotor 7*a* (and therewith the actuating element 7) are rotated back again by the return mechanism 12, but only as far as the rotary position shown in FIG. 9*a* as the adjusting device 8 (switch 8*a* with arresting element 11) prevents any further return movement of the rotor 7*a*.

Figure 10A:
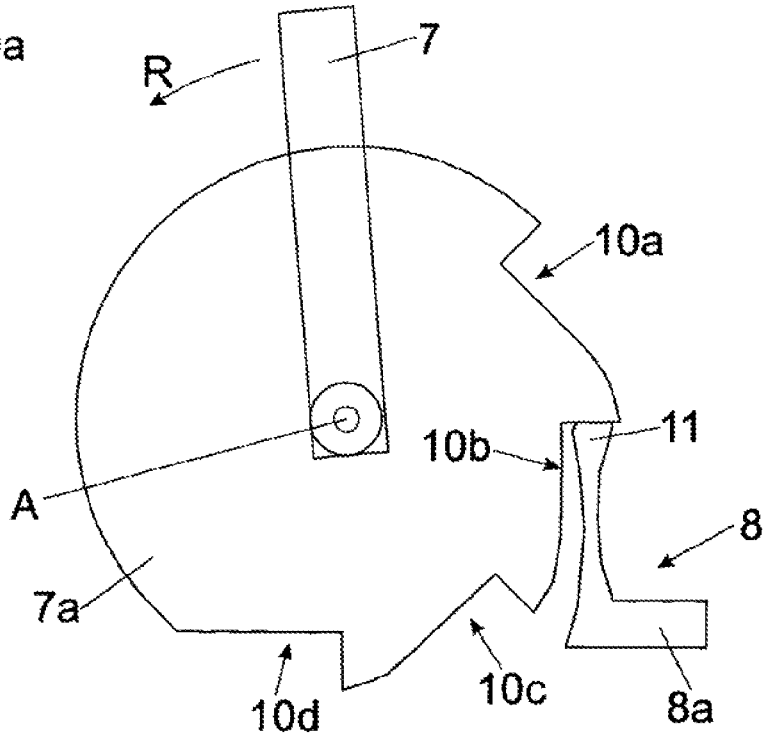
FIGS. 10*a* and 10*b* show views similar to FIGS. 9*a* and 9*b*, with the arresting element arresting the rotor in a direction of rotation in a different recess.
Figure 10B:
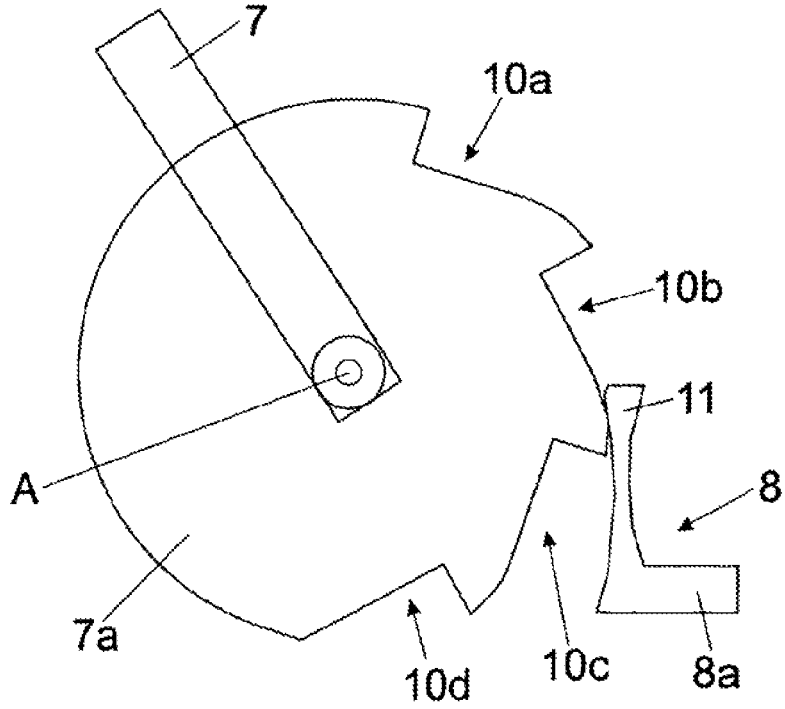

FIGS. 10*a* and 10*b* show the switch 8*a* with the arresting element 11 which, in contrast to FIG. 9*a*, is within the recess 10*b*. The actuating element 7 is movable by virtue of actuation by the hinge lever 6 (FIG. 2*b*) in the direction of the illustrated arrow R (closing direction) about the axis of rotation A, in which case the movable furniture part 2*a* (not visible here) is already in the completely closed position in FIG. 10*b*. Throughout the entire damping stroke, the arresting element 11 is moved exclusively within the tooth width of the recess 10*b* and cannot jump into the recess 10*c* because the movable furniture part 2*a* butting against the furniture carcass 2 prevents further rotary movement of the rotor 7*a*. The desired residual damping power of the damping device 9 is therefore substantially constant (for example 20% of the total damping power)—irrespective of the recess 10*a*-10*d* in which the arresting element 11 is disposed. In principle, therefore, just a single recess 10 in the rotor 7*a* would be sufficient. The provision of a plurality of recesses 10*a*-10*d* however affords the possibility of providing a suitable latching engagement option for the arresting element 11 in the event of deviating installation positions in respect of the furniture hinge 3, deviating end positions in respect of the movable furniture part 2*a*, and/or deviating relative positions of the individual components of the furniture hinge 3 with respect to each other. It should be noted that the damping power can be specifically and targetedly influenced by tooth configurations of varying sizes (that is to say, by virtue of the shape and size of the recesses 10*a* through 10*d*). Greater residual damping powers can also be achieved by virtue of a coarser tooth arrangement (that is to say, larger rotary angle ranges in respect of the recesses 10*a* through 10*d*), and vice-versa.

Figure 11:
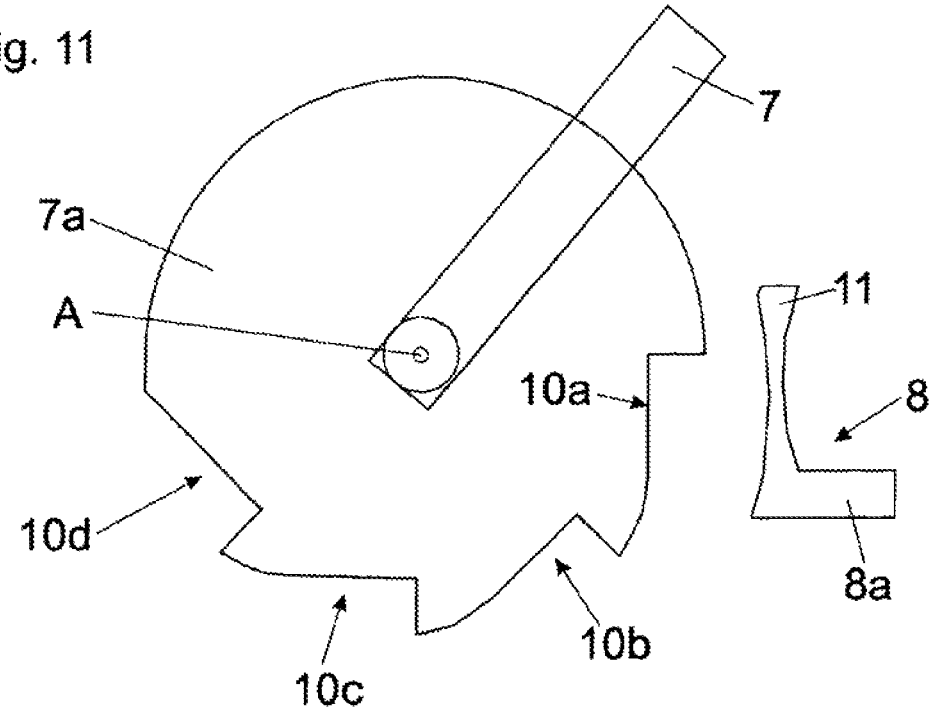
FIG. 11 shows the rotor with an arresting element out of engagement, wherein the maximum damping action of the damping device is available.

FIG. 11 shows the switch 8*a*, the arresting element 11 being not at all in operative relationship with the rotor 7*a*. The actuating element 7 with the rotor 7*a* can therefore be unimpededly rotated during the damping stroke, wherein the entire damping power of the damping device 9 is available for damping the movable furniture part 2*a*. To adjust the location of the damping position of the actuating element 7, the switch 8*a* is displaced in the direction of the arresting position starting from FIG. 11. Upon a closing movement of the movable furniture part 2*a*, the outer round peripheral edge of the rotor 7*a* firstly runs against the arresting element 11. Upon a further closing movement, the arresting element 11 can pass into one of the provided recesses 10*a*-10*c*, depending on which respective recess 10*a*-10*c* corresponds to the completely closed position of the movable furniture part 2*a*. In the subsequent opening movement of the movable furniture part 2*a*, the rotor 7*a* can be moved back by the return mechanism 12 only as far as the radially extending abutment of the respective recess 10*a*-10*c*. In the next damping stroke, the arresting element 11 can only move within the previously determined recess 10*a*-10*c*, whereby the desired residual damping power can be implemented. To restore the entire damping power, the switch 8*a* is moved manually back into the release position so that the rotor 7*a* is again unimpededly rotatable.

Figure 12:
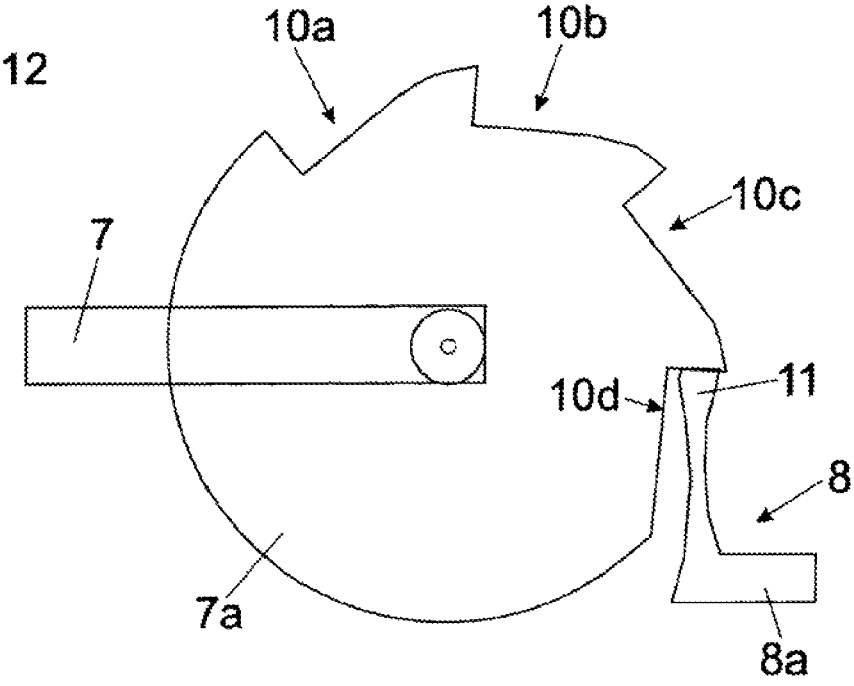
FIG. 12 shows an actuating element which is manually pressed into the hinge cup and which is arrested in that position by the arresting element of the switch whereby the damping action of the damping device is completely deactivated.

FIG. 12 shows the completely deactivated damping function of the damping device 9, wherein the arresting element 11 of the switch 8*a* is in the last recess 10*d*. That position is preferably possible only by a specifically targeted and intentionally implemented manipulation, for example when the pivotably supported actuating element 7 (FIG. 2*b*) is intentionally pushed with a finger completely into the hinge cup 5 and in that case also moves the switch 8*a* in the direction of the arresting position. The damping device 9 is therefore completely ineffective in that position.

The present invention is not limited to the illustrated embodiments, but includes or extends to all variants and technical equivalents which can fall within the scope of the appended claims. The positional details adopted in the description such as for example up, down, lateral and so forth are related to the directly described and illustrated Figure, and are to be appropriately transferred to a fresh position upon a change in position. For the sake of simplicity, a damped movement in the closing direction has been shown in the illustrated embodiments and likewise the described structures can also be used for opening damping of a furniture fitting. By virtue of the described structures—with reference to FIG. 1—one of the two furniture hinges 3 can permit a complete return movement of the actuating element 7 while the other furniture hinge 3 allows the return movement of the actuating element 7 only in part or not at all so that the closing and/or opening time of the movable furniture part 2*a* can be optimized.

The invention claimed is:

1. A damping device for damping at least one of an opening and closing movement of a furniture fitting, said damping device comprising:

a rotational damper;

a rotationally supported actuating element configured to act on said rotational damper during a damping process;

a return mechanism for moving said actuating element back into a starting position of a subsequent damping stroke after the damping process has been effected; and an adjusting device configured to adjustably limit a return stroke of said actuating element relative to said rotational damper such that a location of the starting position of the subsequent damping stroke is thereby adjusted relative to said rotational damper by said adjusting device.

2. The damping device according to claim 1, wherein said adjusting device is configured to stepwise adjustably limit the return stroke of said actuating element relative to said rotational damper at predetermined positions.

3. The damping device according to claim 1, wherein said adjusting device is configured to adjustably limit so as to substantially completely stop the return stroke of said actuating element relative to said rotational damper to thereby effectively deactivate said rotational damper.

4. The damping device according to claim 1, wherein said adjusting device is configured to arrest a movement of said actuating element.

5. The damping device according to claim 1, wherein said adjusting device is configured to arrest a movement of said actuating element in various rotary positions.

6. The damping device according to claim 1, wherein said adjusting device comprises a manually actuatable switch having an arresting element for arresting said actuating element.

7. The damping device according to claim 6, wherein said actuating element has at least one recess for receiving and engaging said arresting element.

8. The damping device according to claim 6, wherein said arresting element has a resilient or spring-loaded latching portion.

9. The damping device according to claim 6, wherein said switch has at least two switching positions.

10. The damping device according to claim 6, wherein said switch is linearly displaceable.

11. The damping device according to claim 1, wherein said actuating element is configured and arranged to be acted upon by a hinge lever of the furniture fitting.

12. The damping device according to claim 1, wherein said return mechanism includes at least one spring.

13. The damping device according to claim 1, wherein said rotational damper and said return mechanism are separate units to be arranged on a furniture fitting.

14. An apparatus comprising:

a furniture fitting having a damping device, said damping device including:

a rotational damper;

a rotationally supported actuating element configured to act on said rotational damper during a damping process;

a return mechanism for moving said actuating element back into a starting position of a subsequent damping stroke after the damping process has been effected; and an adjusting device for adjustably limiting a return stroke of said actuating element relative to said rotational damper such that a location of the starting position of the subsequent damping stroke is thereby adjusted relative to said rotational damper by said adjusting device.

15. The apparatus according to claim 14, wherein said furniture fitting comprises a furniture hinge.

16. The apparatus according to claim 15, wherein said furniture hinge includes a hinge cup, said actuating element being rotatably mounted within said hinge cup.

17. The apparatus according to claim 15, wherein said furniture hinge includes a hinge lever, said actuating element being configured and arranged to be acted upon by said hinge lever at a predetermined relative position of said furniture hinge.

18. The apparatus according to claim 14, wherein said furniture fitting comprises an extension guide for guiding drawers.

19. The apparatus according to claim 14, wherein said furniture fitting comprises an adjusting mechanism for a furniture flap.

20. An article of furniture, comprising:

a furniture carcass;

a movable furniture part movably mounted to said furniture carcass; and a furniture fitting mounted to at least one of said furniture carcass and said movable furniture part, said furniture fitting having a damping device including:

a rotational damper for damping movement of said movable furniture part;

a rotationally supported actuating element configured to act on said rotational damper during a damping process;

a return mechanism for moving said actuating element back into a starting position of a subsequent damping stroke after the damping process has been effected; and an adjusting device for adjustably limiting a return stroke of said actuating element relative to said rotational damper such that a location of the starting position of the subsequent damping stroke is thereby adjusted relative to said rotational damper by said adjusting device.

* * * * *